US007458366B2

(12) United States Patent
Luley et al.

(10) Patent No.: US 7,458,366 B2
(45) Date of Patent: Dec. 2, 2008

(54) FUGITIVE HYDROCARBON TREATMENT MODULE FOR INTERNAL COMBUSTION ENGINE AIR INTAKE SYSTEM

(75) Inventors: Thomas Joseph Luley, Grosse Ile, MI (US); Christian Thomas Goralski, Jr., Ypsilanti, MI (US); Philip J. Johnson, Ann Arbor, MI (US); Andrew George Bellis, Plymouth, MI (US); Gregory Scott Horne, Brownstown Township, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 1240 days.

(21) Appl. No.: 10/063,352

(22) Filed: Apr. 15, 2002

(65) Prior Publication Data

US 2003/0192512 A1 Oct. 16, 2003

(51) Int. Cl.
*F02M 33/02* (2006.01)

(52) U.S. Cl. ..... 123/518

(58) Field of Classification Search ..... 123/520, 123/519, 518, 516, 198 D, 494
See application file for complete search history.

(56) References Cited

U.S. PATENT DOCUMENTS

| | | | | | |
|---|---|---|---|---|---|
| 3,730,158 | A | * | 5/1973 | St. Amand | 123/519 |
| 3,838,673 | A | | 10/1974 | Csicsery et al. | |
| 4,261,717 | A | | 4/1981 | Belore et al. | |
| 4,418,662 | A | * | 12/1983 | Engler et al. | 96/133 |
| 4,711,009 | A | * | 12/1987 | Cornelison et al. | 29/890 |
| 4,783,962 | A | | 11/1988 | Grein | |
| 4,863,700 | A | * | 9/1989 | Ten Eyck | 422/179 |
| 5,207,734 | A | | 5/1993 | Day et al. | |
| 5,441,706 | A | * | 8/1995 | Whittenberger | 422/174 |
| 5,492,883 | A | * | 2/1996 | Wu | 502/439 |
| 5,714,683 | A | * | 2/1998 | Maloney | 73/118.2 |
| 5,755,210 | A | | 5/1998 | Sato et al. | |
| 6,074,973 | A | * | 6/2000 | Lampert et al. | 502/60 |
| 6,167,862 | B1 | * | 1/2001 | Powell et al. | 123/198 E |
| 6,412,471 | B1 | * | 7/2002 | Trublowski et al. | 123/399 |
| 6,464,761 | B1 | * | 10/2002 | Bugli | 96/135 |
| 6,497,848 | B1 | * | 12/2002 | Deeba et al. | 422/180 |
| 6,692,555 | B2 | * | 2/2004 | Oda et al. | 96/134 |

FOREIGN PATENT DOCUMENTS

| | | | |
|---|---|---|---|
| DE | 41-19272 | A1 | 12/1992 |
| EP | 0818-230 | B1 | 1/1998 |
| EP | 0818230 | A1 | 1/1998 |
| WO | WO 01/12973 | A1 | 2/2001 |

* cited by examiner

*Primary Examiner*—Stephen K Cronin
*Assistant Examiner*—Arnold Castro
(74) *Attorney, Agent, or Firm*—Dickinson Wright PLLC; Allan Lippa; Ray Coppiellie

(57) ABSTRACT

A fugitive hydrocarbon treatment module and system for controlling the emission of hydrocarbons from the air intake system of an engine includes a zeolite adsorber unit positioned in the air intake system such that all gases flowing to and from the engine through the air intake system pass through the adsorber, so as to allow hydrocarbons borne by the gases to be adsorbed upon the substrate of the adsorber unit when the engine is shut down and desorbed from the adsorber unit when the engine is in operation.

24 Claims, 4 Drawing Sheets

FUGITIVE HYDROCARBON TREATMENT MODULE FOR INTERNAL COMBUSTION ENGINE AIR INTAKE SYSTEM

BACKGROUND OF INVENTION

1. Field of the Invention

The present invention relates to a device for trapping hydrocarbon from an internal combustion engine fuel system and more specifically, to trapping hydrocarbons which would normally be released from an internal combustion engine intake system when the engine is not operating.

2. Disclosure Information

As automotive tailpipe emission controls have become increasingly more stringent, the emission of hydrocarbons from non-tailpipe or non-fuel tank sources has increasingly come under regulation. For example, California Air Resources Board (CARB) regulations applicable to future models specify that automotive vehicles may emit no more that about 0.35 grams of hydrocarbon per day in terms of evaporative emissions. Of this total, fuel-base hydrocarbon may comprise only 0.054 gm. per day. Because the engine's fuel charging system has the job of combining fuel and air, the fuel charging system provides a source from which fuel can escape from the vehicle through the air intake system when the engine is not operating, or in another words, when the engine is shut down. Thus, any hydrocarbons emitted by the fuel injectors, intake manifold walls, cylinders, or positive crankcase ventilation system may leave the engine and enter the ambient through the air induction or air intake system. Thus, emission levels is high as 0.366 gm per day have been recorded from an engine air intake system alone. A fugitive hydrocarbon treatment module according to present invention provides an apparatus and method for significantly reducing fuel hydrocarbon emissions from sources within the engine.

The present module uses zeolite, which comprises crystalline silicon-aluminum oxide structures capable of forming a weak chemical bond with hydrocarbon molecules of the type typically found in motor gasolines and other engine-borne sources. Although zeolite has a lower overall adsorption capacity than some activated carbon materials, zeolite can produce a much stronger interaction with hydrocarbon molecules, which results in a greater efficiency for the zeolite to trap and prevent hydrocarbon from flowing out of an adsorber. Additionally, the zeolite provides advantages upon purging, whereby the zeolite material releases the trapped hydrocarbons in a much more controlled manner than would activated carbon materials. As a result, efficient operation of the engine is not compromised during purging of the trap.

Although U.S. Pat. No. 3,838,673 discloses the use of zeolite to trap vapor, it is noted that the system of the '673 patent will not prevent the emission of vapor emanating from the induction system apart from the carburetor. Similarly, U.S. Pat. No. 5,207,734 also uses zeolite to trap hydrocarbon vapor from the fuel tank and from the engine when the engine is operating, but cannot prevent the emission of hydrocarbon from the internal regions of the engine when the engine is not in operation.

A system and module according to the present invention solves the problems associated with the prior art by providing complete trapping of hydrocarbons when the engine is off, combined with excellent airflow capability and regeneration of the hydrocarbon adsorber during operation of the engine.

SUMMARY OF INVENTION

A fugitive hydrocarbon treatment module for controlling the emission of hydrocarbon from the air intake system of the engine includes a zeolite adsorber unit positioned in the air intake system such that all air flowing to the engine passes through the adsorber. The adsorber unit may comprise a monolithic substrate having a zeolite-containing washcoat. This may be a metallic substrate such as stainless steel or other ferrous material or non-ferrous material known to those skilled in the art and suggested by this disclosure. The monolithic substrate preferably has a cell density of approximately 25 cells per square inch of substrate surface area, but could contain 1 to 400 cells per inch. As another alternative, the substrate may comprise a cordierite substrate. In any event, the substrate is positioned in the air intake system such that all air flowing through the engine passes through the cells of the substrate both when the engine is operating and when the engine is shut down.

According to another aspect of the present invention, a method for controlling the emission of fugitive hydrocarbon from the air induction system and interior of an internal combustion engine includes the step of causing fugitive hydrocarbon backflowing from the engine air induction system when the engine is shut down to flow through, and be adsorbed upon, a zeolite containing adsorber, and thereafter causing all combustion air entering the engine when the engine is operating to flow through the adsorber so as to desorb and induct previously adsorbed hydrocarbon.

According to another aspect of present invention, a combination air meter and induction system hydrocarbon treatment module for an internal combustion engine includes a total flow hydrocarbon treatment module positioned in the air induction system such that all gases flowing to and from the engine through the air intake system are caused to flow through the hydrocarbon treatment module, and an airflow meter positioned between the hydrocarbon treatment module and the engine such that all air flowing to the engine is caused to flow through the flow meter. Preferably, a single housing contains the hydrocarbon treatment module and the airflow meter. According to yet another aspect of the present invention, a combination air meter and induction system hydrocarbon treatment module may include two monolithic substrates, each having a hydrocarbon adsorbing coating, and an airflow meter mounted between the monolithic substrates.

According to another aspect of the present invention, a combination throttle body, air meter, and induction system hydrocarbon module for an internal combustion engine includes the previously described total flow hydrocarbon treatment module and airflow meter, as well as a throttle body positioned between the airflow meter and the engine. All three components, that is the hydrocarbon treatment module, the airflow meter, and the throttle body may be contained within a single housing. It is an advantage of the present invention that use of a single housing for a hydrocarbon treatment module, for an airflow meter, and for a throttle body according to present invention will prevent air leakage associated with the assembling of numerous components, each requiring independent sealing means and hoses to connect them.

It is an advantage of the present invention that a hydrocarbon treatment module according to this invention is a completely passive device that needs no control valves or efficiency monitoring. This means that the ease of employing such a device in view of onboard diagnostic requirements (OBD) is greatly enhanced.

It is another advantage of the present invention that the present fugitive hydrocarbon treatment module is robust, which is particularly important in the automotive environment in which an engine may occasionally experience backfiring operation.

It is yet another advantage of the present invention that a system including a hydrocarbon treatment module according to this invention provides very little restriction to the flow of air into the engine and thus does not contribute to engine power loss.

Other advantages as well are objects and features of the present invention will become apparent to the reader of this specification.

DETAILED DESCRIPTION

Figure 1:
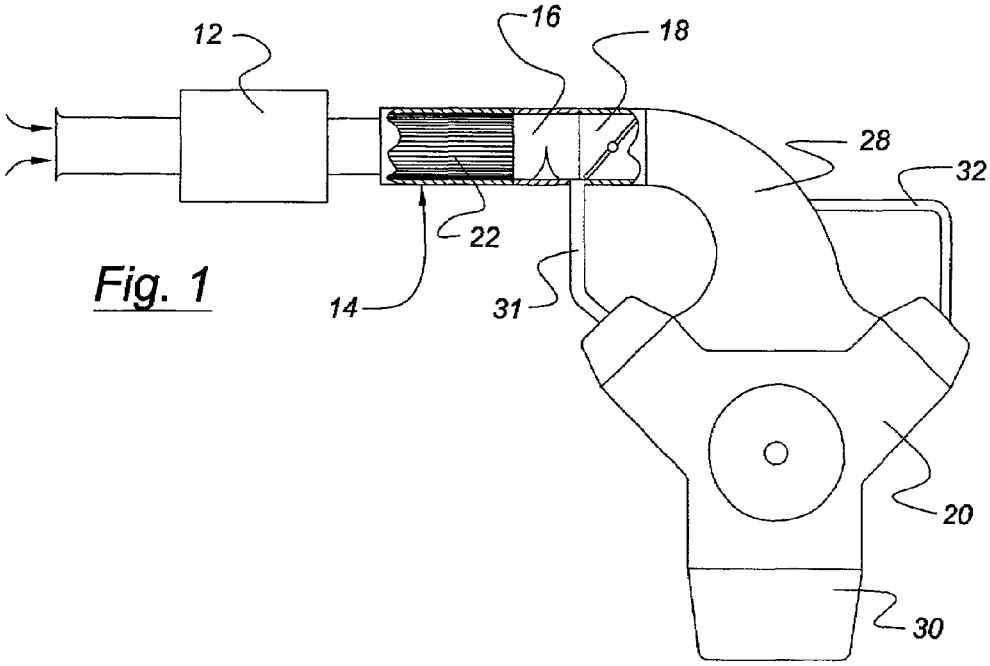
FIG. 1 is a systematic representation of a fugitive hydrocarbon treatment system according to present invention.

Engine 20, having air intake plenum and manifold 28, is supplied with air that first passes through air cleaner 12, and then through fugitive hydrocarbon treatment module 14. Thereafter, the charge air passes through mass airflow sensor 16 and past throttle body 18 into intake manifold 28. From a position between mass airflow meter 16 and throttle body 18, a portion of the incoming airflow is diverted to engine crankcase 30 through hose 31. This diverted air then flows through crankcase 30 and into intake manifold 28 through positive crankcase ventilation (PCV) hose 32.

A plurality of fuel injectors (not shown) provides fuel to the engine. The injectors cooperate with manifold 28 to provide both fuel and air to the engine. However, when the engine is shutdown, fuel vapors may escape from intake manifold 28 and flow back past throttle body 18 and airflow sensor 16. Fuel reaching hydrocarbon treatment module 14 along with any crankcase borne hydrocarbons that backflow through hose 31 will ultimately reach substrate 22, which is shown with more particularity in FIG. 2. Substrate 22 preferably comprises a metallic substrate such as stainless steel, having a zeolite containing washcoat. Alternatively, the substrate may comprise cordierite or another monolithic substrate material known to those skilled in the art and suggested by this disclosure. It is noted with the arrangement of FIG. 1 that all of the air or other gases, both entering the engine while the engine in normal operation and leaving the engine when the engine is shutdown must pass through hydrocarbon treatment module 14. And, this is of course true even when the air contains fugitive hydrocarbons arising from engine 20. Substrate 22, shown in FIG. 2 as noted above, and more particularly in FIG. 5 preferably comprises stainless steel having a cell density of approximately 25 cells per inch of substrate surface area. Substrate 22 may be made according to conventional means by winding up pre-formed sheets and furnace brazing the resulting structure into a single unit.

Figure 5:
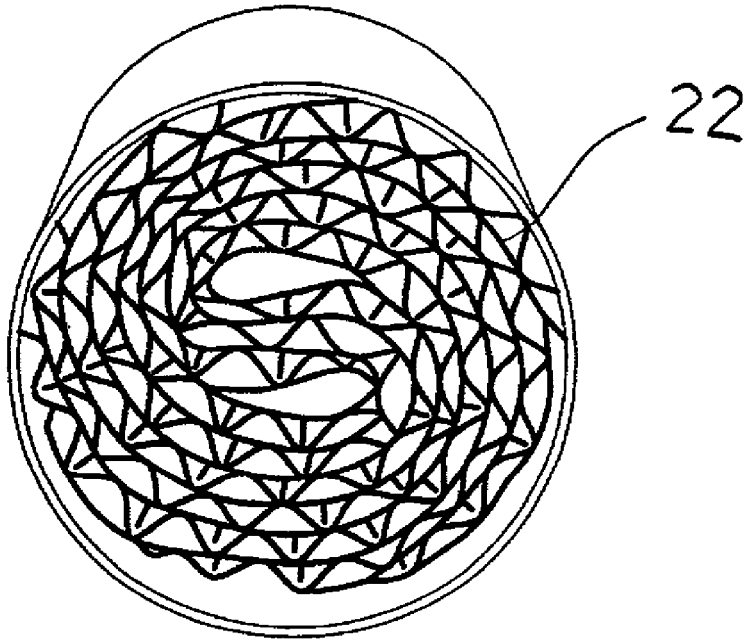
FIG. 5 is a partially perspective view of a first type of monolithic adsorber according to one aspect of the present invention.
Figure 6:
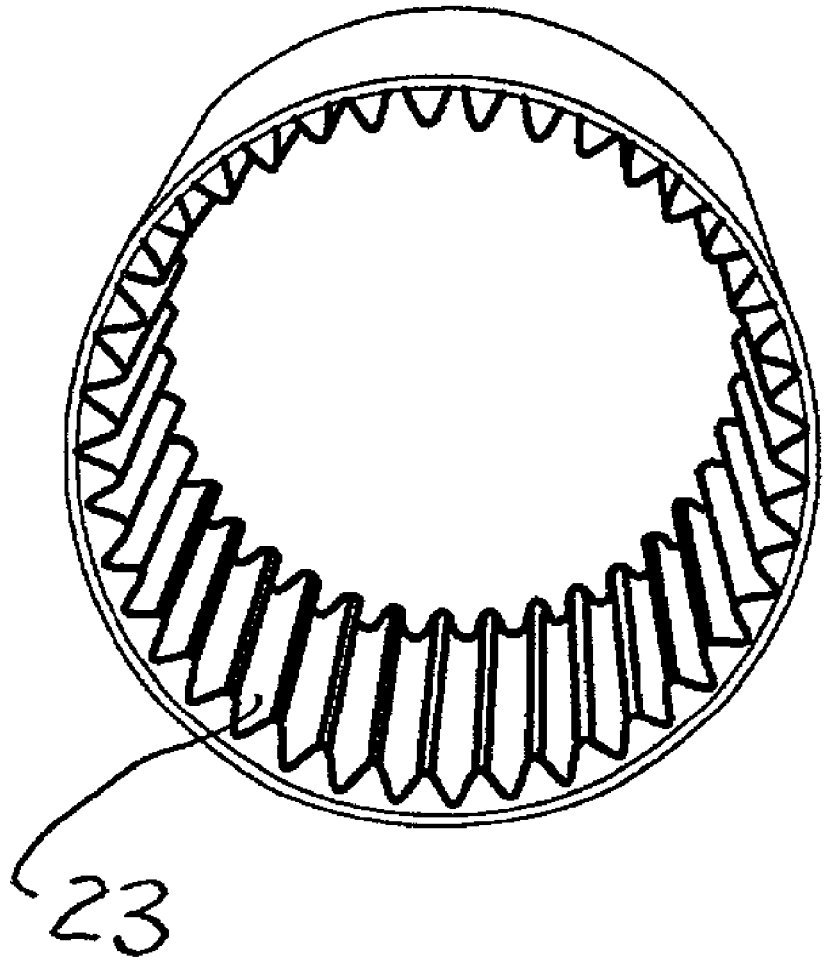
FIG. 6 is a partially perspective view of a second type of monolithic adsorber according to one aspect of the present invention.

FIG. 6 illustrates an alternate embodiment of a substrate suitable for a fugitive hydrocarbon treatment module according to the present invention, in which the substrate does not fill the entire cylindrical inner space of the adsorber, but rather occupies only an annular space about the periphery of the module. In a preferred embodiment, substrate 23 comprises corrugated metal, preferably stainless steel, having an open core area. The adsorbent is applied to the radially inner surface of substrate 23. This configuration is advantageous because it offers the possibility of reduced flow restriction, as compared with the substrate illustrated in FIG. 5.

The inventors of the current fugitive hydrocarbon treatment module have determined that a zeolite based hydrocarbon trap produces excellent result because the flow rate out of the engine air intake system is quite low when the engine is not operating. Because the flow rate is very low, the hydrocarbon flowing through substrate 22 has a very high residence time. This permits adequate time for equilibrium to be established between the zeolite adsorbent and the gas phase adsorbate (i.e., hydrocarbon). As a result, high trapping efficiency is facilitated. Of equal importance however, is the fact that although the interaction between the hydrocarbon and zeolite is strong, the weak chemical bond resulting between the hydrocarbon and zeolite is easily broken once the engine is started because of the high concentration gradient that exists between the hydrocarbon trapped by the zeolite and the hydrocarbon free air flowing to the engine through the air intake system. As a result, the hydrocarbon treatment module is quickly purged of hydrocarbon and ready to accept more hydrocarbon upon the next engine shut down.

In a test, a fugitive hydrocarbon treatment module according to the present invention and having dimensions of approximately in 3 inches in length and 3 inches in diameter and comprising cordierite was coated with zeolite and placed in the induction system of a vehicle having a 2.3 liter 1-4 engine with port fuel injection. The hydrocarbon treatment module operated very effectively and caused about a 95% reduction in fugitive hydrocarbon emission from the engine's air intake system.

In another test, the same 2.3 L 1-4 engine was fitted with a hydrocarbon treatment module of the design shown in FIG. 5 and comprising a metallic substrate of 25 cells per square inch and overall dimensions of 80 mm diameter and 50.4 mm in length. The hydrocarbon treatment module reduced fugitive hydrocarbon emissions by 93 percent on the first day of the test, and by 97 percent on the second day.

In yet another test, the same 2.3 L 1-4 engine was fitted with a hydrocarbon treatment module of the design shown in FIG. 6 with dimensions of 80 mm length and 80 mm diameter. The hydrocarbon treatment module reduced fugitive hydrocarbon emissions by 97% for each day of the test. Those skilled in the art will appreciate in view of this disclosure that the precise dimensions and zeolite loading will need to be determined for any particular engine, taking into account such factors as the type of crankcase ventilation system and the fuel charging system layout.

Figure 2:
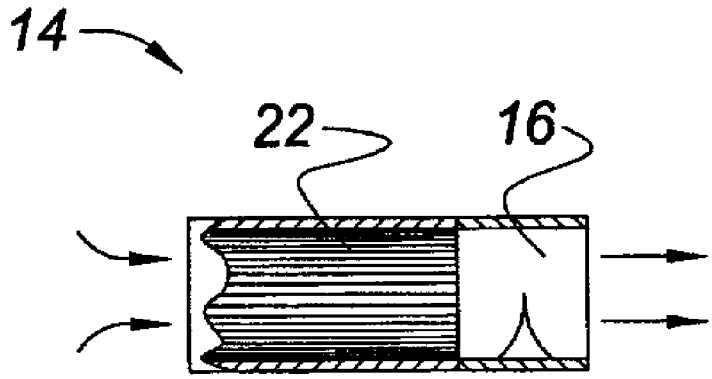
FIG. 2 is a systematic representation of a combined hydrocarbon treatment module and a mass airflow meter according to the present invention.
Figure 3:
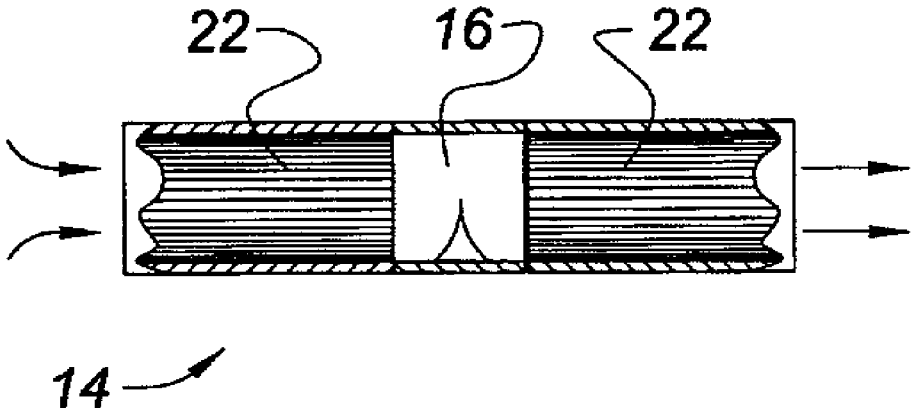
FIG. 3 is a systematic representation of a combined hydrocarbon treatment module having two substrates and a mass airflow meter located there between according to the present invention.

FIG. 2 illustrates a combination air meter and induction system hydrocarbon treatment module according to another aspect of the present invention, in which mass airflow meter 16 is mounted downstream from substrate 22. This is configuration is advantageous because substrate 22 serves to cause laminar flow, so as to present to mass airflow sensor 16 a well developed flow having a very consistent velocity profile. Similarly, FIG. 3 illustrates a combination having two substrates 22 with mass airflow sensor 16 situated therebetween. This configuration offers an additional advantage of isolating mass airflow sensor 16 from flow perturbations arising downstream of the present module. Flow perturbations may inhibit the accuracy of the mass airflow measurement, and thus impair the accuracy of the engine's control system to achieve the desired accuracy of air/fuel ratio control.

Figure 4:
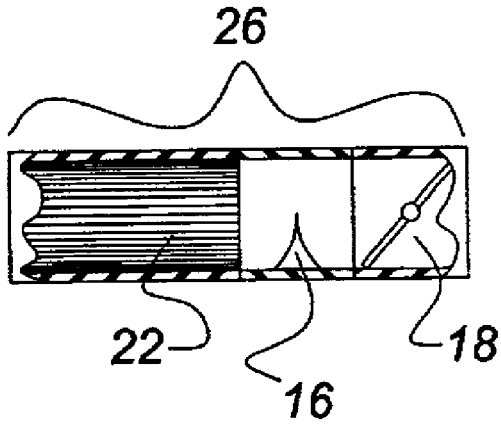
FIG. 4 is a systematic representation of a module including a hydrocarbon treatment module, mass airflow meter and a throttle body according to the present invention.

FIG. 4 illustrates a module containing not only hydrocarbon trapping substrate 22 but also mass airflow meter 16 and the throttle body 18. Each of these components is contained in a single housing which may comprise either a metallic or plastic housing or other type of housing known to those skilled in the art and suggested by this disclosure. In any event, a single housing eliminates the need for multiple clamps hoses and connectors, all of which provide potential leak paths for fugitive hydrocarbon emission.

Although the present invention has been described in connection with particular embodiments thereof, it is to be understood that various modifications, alterations and adaptations may be made by those skilled in the art without departing from the spirit and scope of the invention. It is intended that the invention be limited only by the appended claims.

The invention claimed is:

1. A combination throttle body, air meter, and induction system hydrocarbon module for an internal combustion engine, comprising:

a total flow hydrocarbon treatment module positioned in the air induction system such that all gases flowing both to and from the engine through the air intake system are caused to flow through the hydrocarbon treatment module;

an airflow meter positioned between the hydrocarbon treatment module and the engine such that all air flowing into the engine is caused to flow through the flow meter;

as throttle body positioned between the airflow meter and the engine, for controlling the flow of air into the engine; and a housing for containing said hydrocarbon treatment module, said airflow meter, and said throttle body.

2. A fugitive hydrocarbon treatment module for controlling the emission of hydrocarbons from the air intake system of an engine, comprising a zeolite adsorber unit positioned in the air intake system such that all air flowing through the engine passes through the adsorber, with said adsorber unit comprising a monolithic substrate having a zeolite containing washcoat.

3. A hydrocarbon treatment module according to claim 2, wherein said adsorber unit comprises a metallic substrate having a zeolite containing washcoat.

4. A hydrocarbon treatment module according to claim 2, wherein said adsorber unit comprises an annular metallic substrate having an open core area and a corrugated active adsorbent area.

5. A hydrocarbon treatment module according to claim 3, wherein said substrate comprises a stainless steel substrate.

6. A hydrocarbon treatment module according to claim 3, wherein said substrate comprises a stainless steel substrate having a cell density of approximately 25 cells per square inch of substrate surface area.

7. A hydrocarbon treatment module according to claim 2, wherein said substrate comprises a cordierite substrate.

8. An engine air induction system having a hydrocarbon treatment module for controlling the emission of fugitive hydrocarbons from the air intake system and other interior portions of an engine, with said module comprising a monolithic substrate having a zeolite washcoat, with said substrate being positioned in the air intake system such that all air flowing through the engine passes through the cells of the substrate, both when the engine is operating, and when the engine is shut down.

9. A hydrocarbon treatment module according to claim 8, wherein said substrate comprises a metallic substrate.

10. A hydrocarbon treatment module according to claim 9, wherein said substrate comprises a ferrous metal substrate.

11. A hydrocarbon treatment module according to claim 10, wherein said substrate comprises a stainless steel substrate having a cell density of approximately 25 cells per square inch of substrate surface area.

12. A hydrocarbon treatment module according to claim 9, wherein said substrate comprises a metallic substrate contained within a plastic housing.

13. A hydrocarbon treatment module according to claim 9, wherein said substrate comprises a metallic substrate contained within a metallic housing.

14. A hydrocarbon treatment module according to claim 9, wherein said adsorber unit comprises an annular metallic substrate having an open core area and a corrugated active adsorbent area.

15. An engine air induction system according to claim 8, further comprising an air cleaner mounted on the normally upstream side of the hydrocarbon treatment module.

16. A method for controlling the emission of fugitive hydrocarbons from the air induction system and interior of an internal combustion engine, comprising the steps of causing fugitive hydrocarbons backflowing from the engine's air induction system when the engine is shut down to flow through, and be adsorbed upon, a zeolite containing adsorber comprising a monolithic substrate having a zeolite washcoat; and causing all combustion air entering the engine when the engine is operating to flow through said adsorber, so as to desorb and induct previously adsorbed hydrocarbons.

17. A combination air meter and induction system hydrocarbon treatment module for an internal combustion engine air intake system, comprising:

a total flow hydrocarbon treatment module positioned in the air induction system such that all gases flowing both to and from the engine through the air intake system are caused to flow through the hydrocarbon treatment module;

an airflow meter positioned between the hydrocarbon treatment module and the engine such that all air flowing into the engine is caused to flow through the flow meter; and a housing for containing said hydrocarbon treatment module and said airflow meter.

18. A combination air meter and induction system hydrocarbon treatment module for an internal combustion engine air intake system according to claim 17, wherein said airflow meter is positioned within said housing at a location which is proximate the normally downstream side of the hydrocarbon treatment module.

19. A combination air meter and induction system hydrocarbon treatment module for an internal combustion engine air intake system according to claim 17, wherein said hydrocarbon treatment module comprises a monolithic substrate.

20. A combination air meter and induction system hydrocarbon treatment module for an internal combustion engine air intake system according to claim 19, wherein said hydrocarbon treatment module comprises a monolithic substrate having a zeolite coating.

21. A combination air meter and induction system hydrocarbon treatment module for an internal combustion engine air intake system according to claim 19, wherein said hydrocarbon treatment module comprises a monolithic ferrous metal substrate having a zeolite coating.

22. A combination air meter and induction system hydrocarbon treatment module for an internal combustion engine air intake system according to claim 19, further comprising a second monolithic substrate positioned between the airflow meter and the engine.

23. A combination air meter and induction system hydrocarbon treatment module for an internal combustion engine air intake system according to claim 22, wherein both of said monolithic substrates comprise stainless steel having a zeolite coating.

24. A combination air meter and induction system hydrocarbon treatment module for an internal combustion engine air intake system according to claim 23, wherein both of said monolithic substrates comprise stainless steel having a cell density of approximately 25 cells per square inch.

* * * * *